US005264139A

United States Patent [19]

Mishra et al.

[11] Patent Number: 5,264,139

[45] Date of Patent: Nov. 23, 1993

[54] ANTIOXIDANT DISPERSANT ANTIWEAR VI IMPROVER ADDITIVE AND LUBRICATING OIL COMPOSITION CONTAINING SAME

[75] Inventors: Munmaya K. Mishra; Isaac D. Rubin, both of Wappingers Falls, N.Y.

[73] Assignee: Texaco Inc., White Plains, N.Y.

[21] Appl. No.: 891,133

[22] Filed: Jun. 1, 1992

[51] Int. Cl.[5] ..... C10M 151/04

[52] U.S. Cl. ..... 252/47.5; 252/51.5 A; 252/43; 525/285; 525/322; 525/324; 525/353; 525/384

[58] Field of Search ..... 252/51.5 A, 47.5, 43, 252/34; 525/285, 322, 324, 353, 384

[56] References Cited

U.S. PATENT DOCUMENTS

| | | | |
|---|---|---|---|
| 2,625,511 | 1/1953 | Rocchini | 252/47.5 |
| 4,089,794 | 5/1978 | Engel et al. | 252/56 D |
| 4,137,185 | 1/1979 | Gardiner et al. | 252/33 |
| 4,141,847 | 2/1979 | Kiovsky | 252/51.5 A |
| 4,144,181 | 3/1979 | Elliott et al. | 252/33 |
| 4,200,545 | 4/1980 | Clason et al. | 252/33.4 |
| 4,693,838 | 9/1987 | Varma et al. | 252/51.5 R |
| 4,735,736 | 4/1988 | Chung | 252/51.5 A |
| 4,780,228 | 10/1988 | Gardiner et al. | 252/51 |
| 4,863,623 | 9/1989 | Nalesnik | 252/51.5 A |
| 5,013,469 | 5/1991 | DeRosa et al. | 252/51.5 A |
| 5,049,294 | 9/1991 | Van Zon et al. | 252/51.5 A |

OTHER PUBLICATIONS

Odian, *Principles of Ploymerization*, 2nd ed., John Wiley and Sons, N.Y., pp. 373-374, (1981).

*Primary Examiner*—Prince Willis, Jr.
*Assistant Examiner*—Alan D. Diamond
*Attorney, Agent, or Firm*—James J. O'Loughlin; Vincent A. Mallare

[57] ABSTRACT

A lubricating oil composition comprising (a) a major amount of a base oil having a lubricant viscosity, and (b) a minor amount of, as an antioxidant/dispersant antiwear VI improver additive, a lubricant additive.

13 Claims, No Drawings

ANTIOXIDANT DISPERSANT ANTIWEAR VI IMPROVER ADDITIVE AND LUBRICATING OIL COMPOSITION CONTAINING SAME

BACKGROUND OF THE INVENTION

This invention relates to lubricating oil compositions, and more particularly to an additive which acts as an antioxidant/dispersant, antiwear VI improver when employed in a lubricating oil composition.

There have been many additives developed and prepared for imparting various properties to lubricating oil compositions. However, these additives generally are used for only one need, such as dispersancy, antioxidancy VI improvement, antiwear or the like.

Thus, it is an object of the present invention to provide a cost effective additive which imparts antioxidancy/dispersancy, VI improvement, and antiwear properties to lubricating oil compositions.

DISCLOSURE STATEMENT

U.S. Pat. No.4,089,794 discloses ethylene copolymers derived from ethylene and one or more $C_3$–$C_{20}$ alpha-olefins grafted with an ethylenically unsaturated carboxylic acid material followed by a reaction with a polyfunctional material reactive with carboxyl groups, such as a polyamine, a polyol, or a hydroxylamine which reaction product is useful as a sludge and varnish control additive in lubricating oils.

U.S. Pat. No. 4,137,185 discloses a stabilized imide graft of an ethylene copolymer additive for lubricants.

U.S. Pat. No. 4,144,181 discloses polymer additives for fuel and lubricants comprising a grafted ethylene copolymer reacted with a polyamine, polyol or hydroxylamine and finally reacted with an alkaryl sulfonic acid.

U.S. patent application Ser. No. 07/739,547 discloses derivatized graft copolymer compositions comprising an ethylene alpha-monoolefin copolymer comprising about 15 to about 80 mole % ethylene, about 20 to about 85 mole % of at least one $C_3$–$C_{10}$ alpha-monoolefin and, optionally, 0 to about 15 mole % of a polyene selected from non-conjugated dienes and trienes and having an average molecular weight ranging from about 5,000 to about 500,000; grafted with at least one ethylenically unsaturated carboxylic acid material; and derivatized with a heterocyclic compound of the following general formula

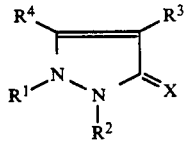

where $R^1$ is hydrogen, aryl, or a branched or straight chain $C_1$–$C_{20}$ alkyl, alkaryl, alkoxyl, alkenyl, hydroxyalkyl, or amino alkyl; $R^2$ is hydrogen, aryl, or a branched or straight chain $C_1$–$C_{20}$ alkyl, alkaryl, alkoxyl, alkenyl, hydroxyalkyl, or amino alkyl; at least one of $R^3$ and $R^4$ is $NH_2$, $CH_2$—$(CH_2)_n$ —$NH_2$, or $CH_2$—aryl—$NH_2$ in which n has a value from 0 to 10, the other $R^3$ and $R^4$, if either, is hydrogen, aryl, or a branched or straight chain ($C_1$–$C_{20}$) alkyl, alkaryl, alkoxyl, alkenyl, hydroxyalkyl, or amino-alkyl; and where X is oxygen, sulfur, or nitrogen.

The disclosures in the foregoing patents and patent application which relate to VI improvers and dispersants for lubricating oils namely U.S. Pat. Nos. 4,089,794, 4.137,185, and 4,144,181; and U.S. patent application Ser. No. 07/739,547 are incorporated herein by reference.

SUMMARY OF THE INVENTION

The present invention provides a lubricating oil composition comprising:

(a) a major amount of a base oil having a lubricant viscosity; and b) a minor amount of, as an antioxidant/dispersant antiwear VI improver additive, a lubricant additive.

DETAILED DESCRIPTION OF THE INVENTION

The polymer or copolymer substrate employed in the lubricating oil additive of the present invention may be prepared from ethylene and propylene or it may be prepared from ethylene and a higher olefin. More complex polymer substrates may be prepared using a third component. The polymerization reaction to form the polymer substrate is generally carried out in presence of a Ziegler-Natta catalyst in a hydrocarbon solvent. The polymer substrate, that is ethylene copolymer or terpolymer, is an oil-soluble, substantially linear, rubbery material having a number average molecular weight ranging from about 10,000 to about 1,000,000 with a preferred molecular weight ranging from about 25,000 to about 250,000 and a most preferred molecular weight ranging from about 50,000 to about 150,000.

An ethylenically unsaturated carboxylic acid material is next grafted onto the predescribed polymer backbone. The preferred compound, maleic anhydride was grafted onto the polymer backbone by free-radical method. Polymer substrates are available commercially. Particularly useful are those containing from about 30 to about 80 mole percent ethylene units, about 70 to about 20 mole percent propylene units. Maleic anhydride grafted polyisobutylene or hydrogenated polybutadiene, polyisoprene or star polymers made from the above or hydrogenated copolymers of butadiene and isoprene with each other or styrene may also be used.

The polymer intermediate possessing carboxylic acid acylating functions is reacted with an amino sulfonylaromatic of the following general formula

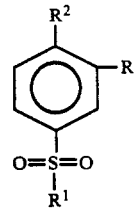

wherein R is $NH_2$, $CH_2$—aryl—$NH_2$ or $CH_2$—$(CH_2)_n$—($NH_2$ in which n is an integer of 1 to 10; $R^1$ is hydrogen, alkyl, alkenyl, alkoxyl, aralkyl, alkaryl, hydroxyalkyl, aminoalkyl, phenyl or naphthyl; and $R^2$ is —OH, alkyl phenol or aryl phenol.

Preferably, the amino sulfonylaromatic compound is: 2-amino-4-(ethylsulfonyl) phenol which is represented by

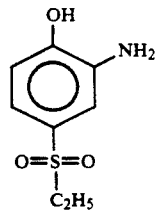

More complex polymer substrates, often designated as interpolymers, may be prepared using a third component. The third component generally used to prepare an interpolymer substrate is a polyene monomer selected from non-conjugated dienes and trienes. The non-conjugated diene component is one having from about 5 to about 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more that one diene can be used in the preparation of the interpolymer. A preferred non-conjugated diene for preparing a terpolymer or interpolymer substrate is 1,4-hexadiene.

The triene component will have at least two non-conjugated double bonds and up to about 30 carbon atoms in the chain. Typical trienes useful in preparing the interpolymer of the invention are 1-isopropylidene-3a,4,7,7a-tetrahydroindene, 1-isopropylidenedicyclopentadiene, dehydro-isodicyclopentadiene, and 2-(2-methylene-4-methyl-3-pentenyl)[2.2.1] bicyclo-5-heptene.

The polyerization reaction to form the polymer substrate is generally carried out in the presence of a catalyst in a solvent medium. The polymerization solvent may be any suitable inert organic solvent that is liquid under reaction conditions for solution polymerization of monoolefins, which is generally conducted in the presence of a Ziegler-Natta type catalyst. Examples of satisfactory hydrocarbon solvents include straight chain paraffins having from about 5-8 carbon atoms, with hexane being preferred. Aromatic hydrocarbons, preferably aromatic hydrocarbons having a single benzene nucleus, such as benzene, toluene and the like, and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. It is desirable that the solvent be free of substances that will interfere with a Ziegler-Natta polymerization reaction.

In a typical preparation of a polymer substrate, hexane is first introduced into a reactor and the temperature in the reactor is raised moderately to about 30° C. Dry propylene is fed to the reactor until the pressure reaches about 40–45 inches of mercury. The pressure is then increased to about 60 inches of mercury and dry ethylene and 5-ethylidene-2-norbornene are fed to the reactor. The monomer feeds are stopped and a mixture of aluminum sesquichloride and vanadium oxytrichloride are added to initiate the polymerization reaction. Completion of the polymerization reaction is evidenced by a drop in the pressure in the reactor.

Ethylene-propylene or higher alpha monoolefin copolymers may consist of from about 15 to about 80 mole % ethylene and from about 20 to about 85 mole % propylene or higher monoolefin, with the preferred mole ratios being from about 30 to about 80 mole % ethylene and from about 20 to about 70 mole % of at least one $C_3$ to $C_{10}$ alpha monoolefin, and with the most preferred proportions being from about 50 to about 80 mole % ethylene and 20 to about 50 mole % propylene.

Terpolymer variations of the foregoing polymers may contain up to about 15 mole % of a non-conjugated diene or triene.

The polymer substrate, that is the ethylene copolymer or terpolymer is an oil-soluble, substantially linear, rubbery material having an average molecular weight from about 5,000 to about 500,000 with a preferred molecular weight range of about 25,000 to about 250,000 and a most preferred range from about 50,000 to about 150,000.

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

The above described polymer substrate of the present invention is an essentially saturated hydrocarbon polymer or copolymer containing only minor amounts of double bonds, if any, prepared using Ziegler-Nalta or ionic catalysts and having an average molecular weight ranging from about 5,000 to about 500,000.

Other substrates can be made through ionic polymerization or copolymerization of isoprene, butadiene, and other conjugated dienes and copolymerization of the above and with each other in hydrocarbon solvents, followed by hydrogenation to eliminate most or all of the aliphatic unsaturation. Alkyl lithium derivatives are suitable catalysts, an example being butyl lithium. Alternatively, the living polymer/copolymers chains prior to catalyst removal can be reacted further with divinylbenzene or other difunctional monomers or oligomers of these materials to create star polymers, which are hydrogenated as above. To be useful substrates for this invention, these linear or star polymers and copolymers can range in average molecular weight from about 10,000 to about 500,000 and the number of arms on the star polymers and copolymers is between 3 and 25.

An ethylenically unsaturated carboxylic acid material is next grafted onto the polymer backbones described above. These materials which are attached to the polymer contain at least one ethylenic bond and at least one, preferably two, carboxylic acid (or its anhydride) groups or a polar group which is convertible into said carboxyl groups by oxidation or hydrolysis. Maleic anhydride or a derivative thereof is preferred. It grafts onto the backbone to give two carboxylic acid functionalities. Examples of additional unsaturated carboxylic materials include chlormaleic anhydride, itaconic anhydride, or the corresponding dicarboxylic acids, such as maleic acid, fumaric acid and their monoesters.

The ethylenically unsaturated carboxylic acid material may be grafted onto the polymer in a number of ways. It may be grafted onto the polymer by a thermal process known as the "ene" process or by grafting in solution or in solid form using a radical initiator. The free-radical induced grafting of ethylenically unsaturated carboxylic acid materials in solvents, such as benzene is a preferred method. It is carried out at an elevated temperature in the range of about 100° C. to about 250° C., preferably 120° C. to about 190° C., and more preferably at 150° C. to about 180° C., e.g., above 160° C., in a solvent, preferably a mineral lubricating oil solution containing, e.g., 1 to about 50 wt. %, preferably 5 to about 30 wt. %, based on the initial total oil solution, of the backbone polymer and preferably under an inert environment.

The free-radical initiators which may be used are peroxides, hydroperoxides, and azo compounds and preferably those which have a boiling point greater than about 100° C. and which decompose thermally within the grafting temperature range to provide free radicals. Representative of these free-radical initiators are azobisisobutyronitrile and 2,5-dimethyl-hex-3-yne-2,5 bis-tertiary-butyl peroxide. The initiator is used in an amount of between about 0.005% and about 1% by weight based on the weight of the reaction mixture solution. The grafting is preferably carried out in an inert atmosphere, such as under nitrogen blanketing. The resulting polymer intermediate is characterized by having carboxylic acid acylating functions within its structure.

In the solid or melt process for forming a graft polymer, the unsaturated carboxylic acid with the optional use of a radical initiator is grafted onto molten rubber using rubber masticating or shearing equipment. The temperature of the molten material in this process may range from about 150° C.–400° C.

According to the present invention, a particularly preferred amino sulfonylaromatic compound is 2-amino-4-(ethyl sulfonyl) phenol represented by the formula

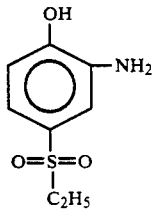

The reaction between the polymer substrate intermediate having grafted thereon carboxylic acid acylating function and the heterocyclic compound is conducted by heating a solution of the polymer substrate under inert conditions and then adding the heterocyclic compound to the heated solution, generally with mixing, to effect the reaction. It is convenient to employ an oil solution of the polymer substrate heated to about 140° C. to about 175° C. while maintaining the solution under a nitrogen blanket. The heterocyclic compound is added to this solution and the reaction is effected under the noted conditions.

The following Example is provided to illustrate the advantages and effectiveness of the present invention.

EXAMPLE I 30 grams of solid maleic anhydride graft polymer (rubber) in which the polymer substrate consisted of about 60 mole percent ethylene and 40 mole percent propylene having an average molecular weight of 100,000 on which had been grafted 0.8 weight percent of maleic anhydride was dissolved in 191 grams of solvent neutral oil at 160° C., with mechanical stirring while the mixture was maintained under a nitrogen blanket. After the rubber polymer was dissolved, mixing was continued for an additional hour at 160° C. Then, 0.75 gram of neat 2-amino-4-(ethylsulfonyl) phenol followed by 9 grams of a low molecular weight ethylene oxide polymer (such as Surfonic L24-7 manufactured by Texaco Chemical Company of Houston, Tex.) was added to the oil solution of the polymer and a reaction effected over 3 hours at 160° C. under nitrogen. The reaction mixture containing the derivatized graft polymer was then cooled and filtered. The FTIR showed quantitative conversion.

The novel graft and derivatized polymers of the present invention are useful as additives for lubricating oils. They are multi-functional additives for lubricants being effective in providing dispersancy, viscosity index improvement, anti-wear, and anti-oxidant properties to lubricating oils. They can be employed in a variety of oils of lubricating viscosity including natural and synthetic lubricating oils and mixtures thereof.

The dispersant properties of the additive-containing oil were determined in a bench VE Dispersancy Test (BVET). Dispersancy of a lubricating oil was determined relative to two references which are the original ethylene-propylene backbone (EPM) and the EPM grafted with maleic anhydride (EPSA). The present additive reaction product was employed in the oil at a concentration of 1.25 weight percent. The numerical value of the test results decreases with an increase in effectiveness. The numerical test results are provided below in Table I.

TABLE I

BENCH VE DISPERSAN TEST

| Additive | Result |
|---|---|
| Example I | 54 |
| Maleic anhydride grafted (EPSA) | 190 |
| Ethylene-Propylene Copolymer (EPM) | 200 |

The anti-oxidant properties of the novel reaction product in a lubricating oil were determined in the Bench Oxidation Test. In this test, 1.5 weight percent of the additive reaction product is blended into solvent neutral oil. The mixture is continuously stirred while being heated accompanied by bubbling with air. Samples are withdrawn periodically for analysis by Differential Infrared Absorption (DIR) to observe changes in the carboxyl vibration band intensity at 1710 $cm^{-1}$. As provided below in Table II, the numerical value of the test results decreases with an increase in effectiveness.

TABLE II

BENCH OXIDATION TEST

| Additive | Result |
|---|---|
| Example I | 6.7 |
| Maleic anhydride grafted (EPSA) | 15.0 |

The anti-wear properties of the novel reaction product in a lubricating oil were determined in the 4-Ball Wear Test (4BWT) at two different test conditions. The anti-wear of the lubricating oil was determined relative to one reference which is the result of EPM grafted with maleic anhydride (EPSA). The additive reaction product was employed in the oil at a concentration of 1.5 weight percent polymer solution. As shown below in Table III, the numerical value of the test results decreases with an increase in effectiveness.

TABLE III

| 4-BALL WEAR TEST | | |
|---|---|---|
| | EPSA Polymer | Example 1 Avg. Scar Diameter. (mm) |
| Condition A. | 0.63 | 0.53 |
| Condition B. | 0.51 | 0.43 |

Condition A: 600 rpm, 40 kg, 200° F., 30 min., L-689-4804.00* base blend oil, in the presence of cumene hydroperoxide (80%) 1.7 wt % to increase test severity.
Condition B: 1800 rpm, 40 kg, 200° F., 2 hr., L-689-4804.00* base blend oil.
*L-689-4804.00 is a 5W-30 oil blend without an antiwear agent or VI Improver.

We claim:

1. A lubricating oil composition comprising:

a) a major amount of a base oil having a lubricant viscosity; and b) a minor amount of, as an antioxidant/dispersant anti-wear VI improver lubricant additive, said additive comprising:

(i) an essentially saturated hydrocarbon polymer or copolymer containing only minor amounts of double bonds, prepared using ionic catalysts and having a number average molecular weight ranging from about 5,000 to about 500,000;

(ii) at least one ethylenically unsaturated carboxylic acid material grafted onto said polymer or copolymer; and (iii) an amino sulfonyl aromatic compound which is reacted with the carboxylic acid groups of the carboxylic acid material-grafted copolymer and is represented by the formula

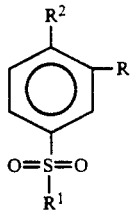

wherein R is $NH_2$, $CH_2-aryl-NH_2$ or $CH_2-(CH_2)_n-NH_2$ in which n is an integer of 1 to 10; $R^1$ is hydrogen, alkyl, alkenyl, alkoxyl, aralkyl, alkaryl, hydroxyalkyl, aminoalkyl, phenyl or naphthyl; and $R^2$ is —OH, alkyl phenol or aryl phenol.

2. The lubricating oil composition of claim 1, wherein said amino sulfonylaromatic compound is 2-amino-4-(ethylsulfonyl) phenol represented by the formula

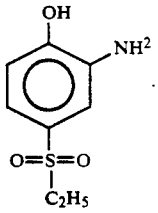

3. The lubricating oil composition of claim 1, wherein the polymer is a hydrogenated linear polymer or copolymer of butadiene, isoprene, their mixtures or their mixtures with styrene.

4. The lubricating oil composition of claim 1, wherein said copolymer has a number average molecular weight ranging from about 25,000 to about 250,000.

5. The lubricating oil composition of claim 1, wherein said polymer is a star polymer.

6. The lubricating oil composition of claim 1, wherein the polymer is a star polymer with hubs of divinylbenzene and arms of hydrogenated chains of isoprene, butadiene or their copolymers with each other or styrene.

7. The lubricating oil composition of claim 1 wherein the ethylenically unsaturated carboxylic acid material is maleic anhydride.

8. The lubricating oil composition of claim 1 wherein the polymerization catalyst is butyl lithium.

9. A lubricating oil composition comprising:

a) a major amount of a base oil having a lubricant viscosity; and b) a minor amount of as an antioxidant dispersant VI improver lubricant additive, said additive comprising:

(i) an ethylene alpha-monoolefin copolymer comprising about 15 to about 80 mole % ethylene, about 20 to abut 85 mole % of at least one ($C_3$–$C_{10}$) alpha-monoolefin and, optionally, 0 to about 15 mole % of a polyene selected from non-conjugated dienes and trienes and having an average molecular weight ranging from about 5,000 to about 500,000;

(ii) at least one ethylenically unsaturated carboxylic acid material grafted onto said copolymer; and (iii) an amino sulfonyl aromatic compound which is reacted with the carboxylic acid groups of the carboxylic acid material-grafted copolymer and is represented by the formula

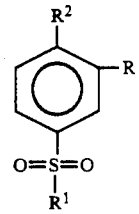

wherein R is $NH_2$, $CH_2-aryl-NH_2[CH_2]$ or $CH_2-(CH_2)_n-NH_2$ in which n is an integer of 1 to 10; $R^1$ is hydrogen, alkyl, alkenyl, alkoxyl, aralkyl, alkaryl, hydroxyalkyl, aminoalkyl, phenyl or naphthyl; and $R^2$ is —OH, alkyl phenol, or aryl phenol.

10. The lubricating oil composition of claim 9, wherein said amino sulfonylaromatic compound is 2'-amino-4'-amino-(ethylsulfonyl) phenol represented by the formula

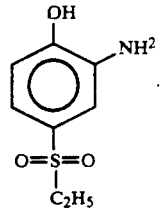

11. The lubricating oil composition of claim 9, wherein said copolymer has a number average molecular weight ranging from about 25,000 to about 250,000.

12. The lubricating oil composition of claim 9, wherein said copolymer has a number average molecular weight ranging from about 50,000 to about 150,000.

13. The lubricating oil composition of claim 9, wherein the ethylenically unsaturated carboxylic acid material is maleic anhydride.

* * * * *